US007932474B2

(12) United States Patent
Hamada et al.

(10) Patent No.: US 7,932,474 B2
(45) Date of Patent: Apr. 26, 2011

(54) ILLUMINATED DUAL ACTION SWITCH

(75) Inventors: Kenichi Hamada, Aichi (JP); Eiichi Hayakawa, Aichi (JP); Tatsuya Futamura, Aichi (JP); Fumitaka Hayase, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 85 days.

(21) Appl. No.: 12/485,397

(22) Filed: Jun. 16, 2009

(65) Prior Publication Data

US 2009/0308719 A1 Dec. 17, 2009

(30) Foreign Application Priority Data

Jun. 16, 2008 (JP) ..... 2008-156528

(51) Int. Cl.
*H01H 9/00* (2006.01)

(52) U.S. Cl. ..... 200/310

(58) Field of Classification Search ..... 200/4, 310, 200/313, 314
See application file for complete search history.

*Primary Examiner* — Edwin A. Leon
*Assistant Examiner* — Vanessa Girardi
(74) *Attorney, Agent, or Firm* — Morgan, Lewis & Bockius LLP

(57) ABSTRACT

An illuminated switch comprising a four-way knob and a push knob, wherein the push knob has two legs which slide along a guide surface on an internal pusher member. Tilt activation of the four-way knob results in the push knob also being tilted. When the user has pushed the push knob while the push knob and the four-way knob are in a tilted position, the push knob in conjunction with the four-way knob linearly move backward in the pushed direction, whereby an internal switch and an external switch are operated. The push knob is illuminated by an internal LED by way of a through hole in the internal pusher member.

3 Claims, 4 Drawing Sheets

Prior Art

ILLUMINATED DUAL ACTION SWITCH

BACKGROUND OF THE INVENTION

The present invention relates to a vehicle switch to be operated by a driver of a vehicle.

A related-art configuration of the switch is described by reference to FIG. 4. A switch case 101 has a switch board 102, and a pusher member 103 is provided in the switch case 101. The pusher member 103 is pushed from a first position to a second position that is closer to the switch board 102 rather than to the first position, and a columnar knob receiver 104 is made on the pusher member 103. The knob receiver 104 has a planar guide surface 105, and legs 107 of an internal knob 106 are supported by the guide surface 105. An annular external knob 108 is fixed to the internal knob 106. When the external knob 108 is pressed toward the switch board 102, the internal knob 106 is tilted around a contact point between the leg 107 and the guide surface 105, along with the external knob 108. When pressed toward the switch board 102 while both the internal knob 106 and the external knob 108 remain inclined, the internal knob 106 linearly moves toward the switch board 102 in conjunction with the external knob 108. The switch board 102 is provided with an external switch. As the external knob 108 linearly moves toward the switch board 102 along with the internal knob 106, the external switch is operated by way of the external knob 108. The switch board 102 is equipped with an internal switch. In accordance with linear movement toward the switch board 102, the internal knob 106 pushes the pusher member 103 from the first position to the second position, whereupon the pusher member 103 is pushed from the first position to the second position, to thus actuate the internal switch.

In the related-art configuration, the leg 107 of the internal knob 106 is supported by the knob receiver 104 of the pusher member 103, thereby allowing inclination of the internal knob 106 and linear movement of the internal knob 106 toward switch board 102. Therefore, when the switch board 102 is equipped with a light source 109, light projected by the light source 109 is blocked by the knob receiver 104 and the leg 107. Therefore, it is impossible to illuminate the internal knob 106 from the direction of the switch board 102.

SUMMARY OF THE INVENTION

The present invention has been conceived in light of the circumstance and aims at providing a vehicle switch that enables a light source to illuminate an internal knob in the direction of a switch board.

According to a first aspect of the invention, a switch comprises;

a switch case that supports a switch board;

a pusher member that is provided in the switch case, is operative to be pushed from a first position to a second position located closer to the switch board than the first position, and includes a spherical guide surface on a side opposite to the switch board and a through hole;

an internal knob that is operated by a user and includes a plurality of legs supported by the guide surface;

a light source that is provided on the switch board and illuminates the internal knob by projecting light into the internal knob through the through hole; and an annular external knob that is operated by the user and surrounds the internal knob, wherein, when the external knob is pushed toward the switch board, the guide surface allows sliding action of the plurality of legs to tilt both the external knob and the internal knob, wherein, when the internal knob is pushed toward the switch board while the internal knob and the external knob remain tilted, the plurality of legs are prohibited from performing sliding action, thereby causing the internal knob to linearly move toward the switch board along with the external knob, wherein the pusher member is pushed by the internal knob from the first position to the second position in response to the internal knob linearly moving toward the switch board along with the external knob, and wherein the switch board includes an external switch that is operated in response to the external knob linearly moving toward the switch board and an internal switch that is operated by way of the pusher member in response to the internal knob linearly moving toward the switch board.

According to a second aspect of the invention, in the switch in the first aspect, a plurality of the external switches are arranged along a common circular path, and the internal switch is arranged at a radially inside of the common circular path.

According to a third aspect of the invention, the switch in the first aspect further comprises an external knob inserted into a pusher housing portion formed at the switch case, wherein when the external knob linearly moves toward a switch board, the external knob pushes the external switch through the external pusher member.

When the car driver has pushed the external knob toward the switch board, the plurality of legs of the internal knob are allowed to slidably move along the guide surface of the pusher member, whereupon the external knob is tilted in the direction of operation of the external knob along with the internal knob, and the external switch is operated. When the car driver has pushed the internal knob toward the switch board while the external knob and the internal knob remain tilted, the plurality of legs of the internal knob are prohibited from slidably moving along the guide surface of the pusher member, whereby the internal knob linearly moves in the direction of operation of the internal knob in conjunction with the external knob, and the internal switch is operated. Therefore, a through hole is provided in the pusher member, and light is projected from the light source of the switch board on the internal knob by way of the through hole of the pusher member, so that the internal knob can be illuminated.

DETAILED DESCRIPTION OF PREFERRED EMBODIMENTS

First Embodiment

Figure 1:
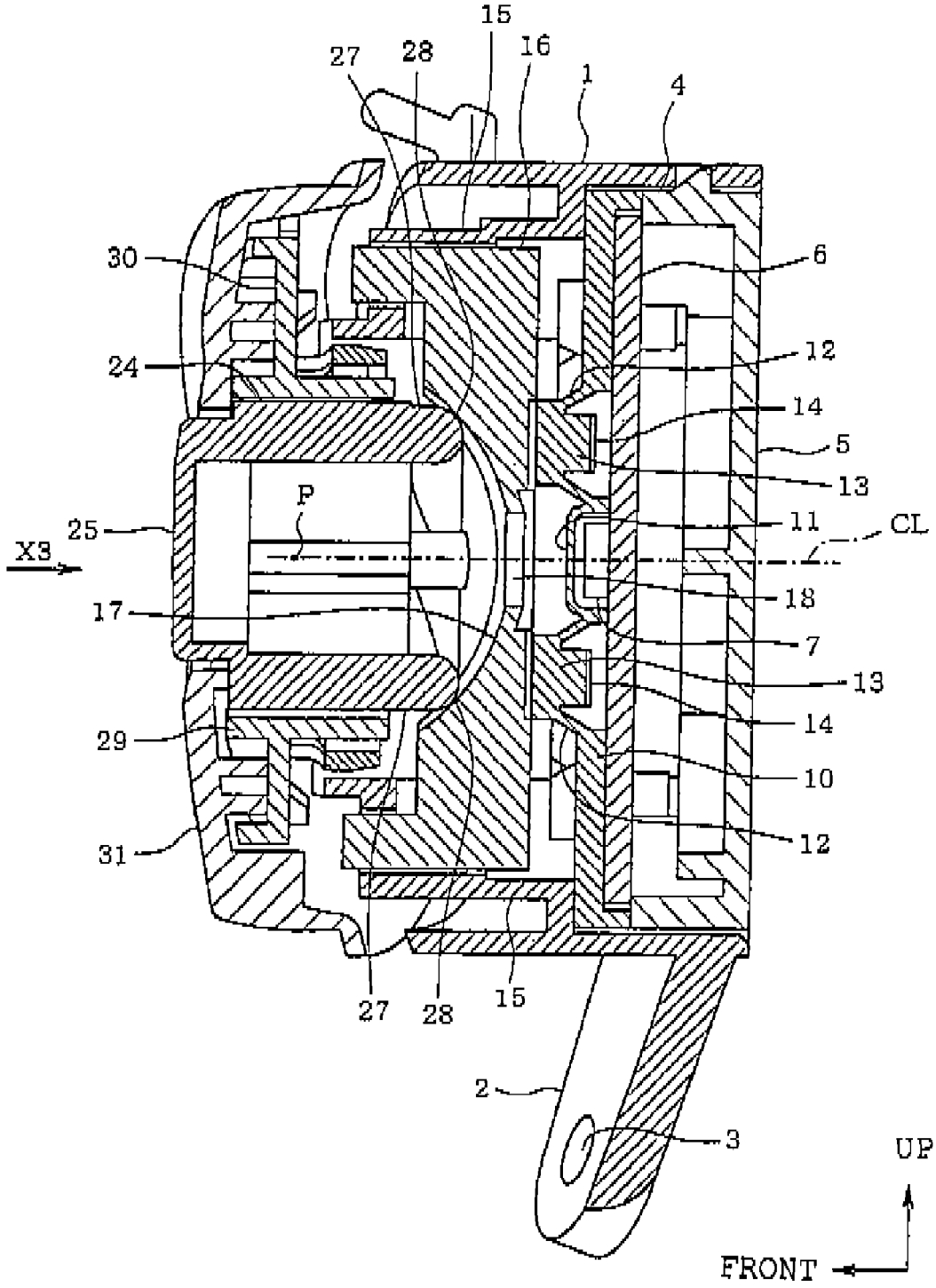
FIG. 1 is a view showing a first embodiment of the present invention (a cross-sectional view taken along line X1 in FIG. 3)

As shown in FIG. 1, a switch case 1 assumes a cylindrical shape whose front and back surfaces are opened, and a plurality of mount plates 2 are made on the switch case 1. The plurality of mount plates 2 protrude from an outer periphery of the switch case 1, and mount holes 3 are made respectively in the plurality of mount plates 2. Screws are inserted into the plurality of mount holes 3 from the front, respectively. The switch case 1 is fixed by screw-engaging the plurality of screws into the respective mount surfaces.

As shown in FIG. 1, a cylindrical board receiver 4 is fitted into an inner periphery of the switch case 1, and a disc-shaped cover 5 that closes a back surface of the switch case 1 is provided on the board receiver 4. A switch board 6 made of a printed wiring board is supported by a front surface of the board receiver 4. The switch board 6 assumes a disk shape concentric with respect to the switch case 1. As shown in FIG. 2, an internal LED 7, an external LED 8, and an external LED 9 are provided on a front surface of the switch board 6. The internal LED 7, the external LED 8, and the external LED 9 respectively project light from behind to front at right angles to the switch board 6. The internal LED 7 is placed at a center point CP of the switch board 6, and the external LED 8 and the external LED 9 are placed along a common circular path centered on the center point CP of the switch board 6. The internal LED 7 corresponds to a light source.

As shown in FIG. 1, a front surface of the switch board 6 is covered with a transparent sheet 10 made of rubber. Three translucent portions 11 are made in the sheet 10. The internal LED 7, the external LED 8, and the external LED 9 are covered with the respective translucent portions 11 from the front. The three translucent portions 11 are referred to as areas that are thinner than an area of the sheet 10 directly covering the front surface of the switch board 6 in terms of a thickness achieved in the longitudinal direction and that exhibit higher translucency than does the same. Light beams projected respectively from the internal LED 7, the external LED 8, and the external LED 9 pass through the translucent portions 11 located ahead of the LEDs, to thus travel forward.

As shown in FIG. 1 expandable portions 12 are made at locations on the sheet 10 that are obliquely upper left and lower right with respect to the internal LED 7. Each of the expandable portions 12 assumes a cylindrical shape that becomes smaller in diameter from the rear to the front and placed along a common circular path centered at the center point CP of the switch board 6. An internal contact holder 13 is made in a front end of each of the expandable portions 12. Each of the internal contact holders 13 assumes a columnar shape directed in a front-back direction. An internal movable contact point 14 is fixed on a back surface of each of the internal contact holders 13. Internal stationary contact points are provided at positions on the front surface of the switch board 6 at the rearward of the respective internal movable contact points 14. The internal movable contact points 14 make up an internal switch in conjunction with the respective rear internal stationary contact points. The internal movable contact points 14 are held in an OFF position spaced apart from the rear internal stationary contact points, by means of elastic force of the expandable portions 12. The respective internal movable contact points 14 move to an ON position that is at the rear of the OFF position and where the movable contact points contact the internal stationary contact points, along with elastic contraction of the expandable portions 12. The internal movable contact points reset themselves from the ON position to the OFF position by means of the elastic restoration force of the expandable portions 12.

Figure 2A:
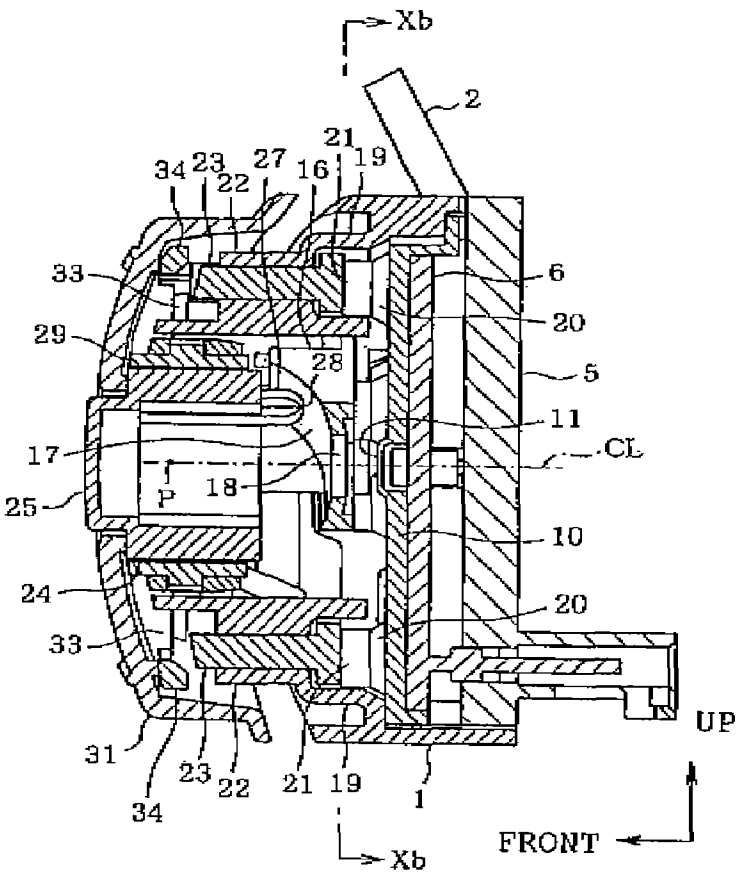
FIG. 2A is a cross-sectional view taken along line X2 in FIG. 3.
Figure 2B:
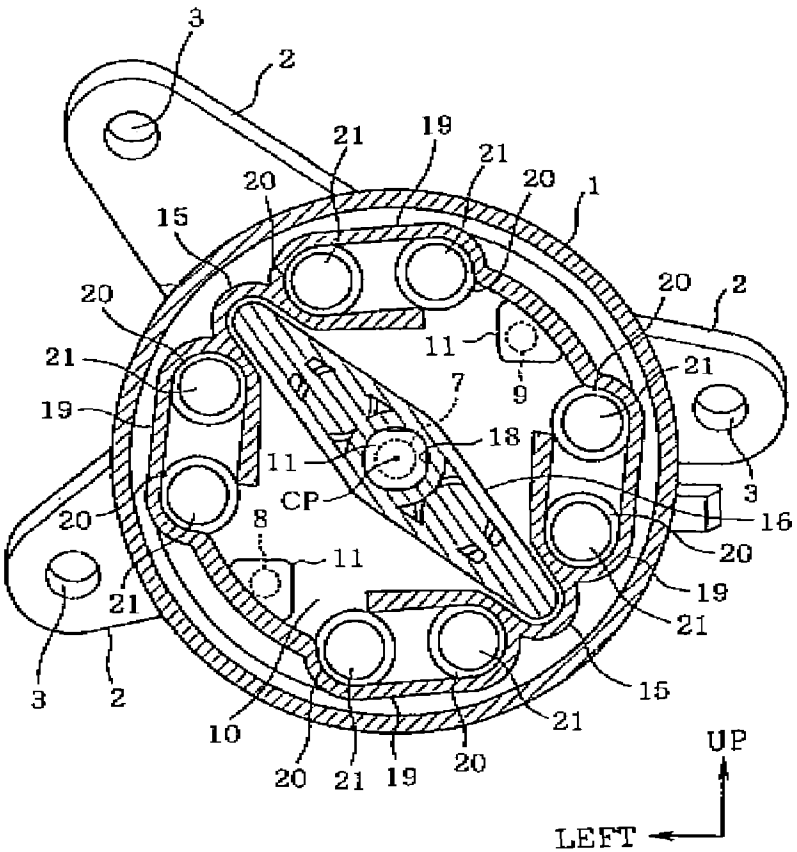
FIG. 2B is a cross-sectional view taken along line Xb in FIG. 2.

As shown in FIGS. 2A and 2B, two guide plates 15 are provided in the switch case 1. The respective guide plats 15 are diagonally arranged with three elements; namely, the internal LED 7 and the internal contact holders 13, sandwiched therebetween when viewed from the above. An internal pusher member 16 is inserted between the guide plates 15. The internal pusher member 16 is made linearly movable, along the respective guide plates 15, between a non-operation position and an operation position located at the rear of the non-operation position. The internal pusher member 16 is held at the non-operation position by elastic force of the respective expandable portions 12 of both internal contact holders 13. The internal pusher member 16 corresponds to the pusher member. The non-operation position of the internal pusher member 16 corresponds to a first position, and the operation position of the internal pusher member 16 corresponds to a second position.

As shown in FIG. 1, a guide surface 17 is made on the internal pusher member 16. The guide surface 17 is formed from a spherical surface that is rearwardly concave with reference to a center point P on an axial center line CL of the switch case 1, and a circular through hole 18 is at a position on the internal pusher member 16 corresponding to the lowest bottom portion of the guide surface 17. Light projected from the internal LED 7 passes through the through hole 18, and the through hole 18 is made up of a through hole positioned opposite the internal LED 7 from the front and along the axial center line CL of the switch case 1.

As shown in FIGS. 2A and 2B, four holder housing portions 19 are made in the switch case 1. The four holder housing portions 19 are arranged, in a circumferential direction, at equal pitches along a common circular path centered on the axial center line CL of the switch case 1. Each of the holder housing portions assumes a cylindrical shape whose front and back surfaces are open. Two expandable portions 20 are made in each of the respective four holder housing portions 19 on the sheet 10 of the switch board 6. Each of the total of eight expandable portions 20 assumes a cylindrical shape whose diameter becomes smaller from the rear to the front as in the case of the expandable portion 12. An external contact holder 21 is made at a front end of each of the eight expandable portions 20. An external movable contact point is fixed to a back surface of each of the eight external contact holders 21, and external stationary contact points are provided at positions on the front surface of the switch board 6 located rearward of the respective eight external movable contact points. The eight external movable contact points make up an external switch along with the corresponding rear external stationary contact points. The external movable contact points are held at an OFF position spaced apart from the rear external stationary contact points by elastic force of the expandable portions 20. The eight external movable contact points move from the OFF position to an ON position that is located rearward of the OFF position and where the external movable contact points contact the external stationary contact points, along with elastic contraction of the respective expandable portions 20. The external movable contact points reset themselves from the ON position to the OFF position by means of the elastic restoration force of the expandable portions 20.

As shown in FIGS. 2A and 2B, a pusher housing portion 22 is made at respective positions of the four holder housing portions 19 in the switch case 1. Each of the four pusher housing portions 22 assumes a cylindrical shape oriented in its front-back direction. A columnar external pusher member 23 oriented in its front-back direction is inserted into each of the four pusher housing portions 22. The four external pusher members 23 are made linearly movable, along respective internal peripheries of the pusher housing portions 22, between a non-operation position and an operation position that is located at the rear of the non-operation position. The external pusher members are held at the non-operation position by elastic force of the respective expandable portions 20 of the rear external contact holders 21.

Figure 3:
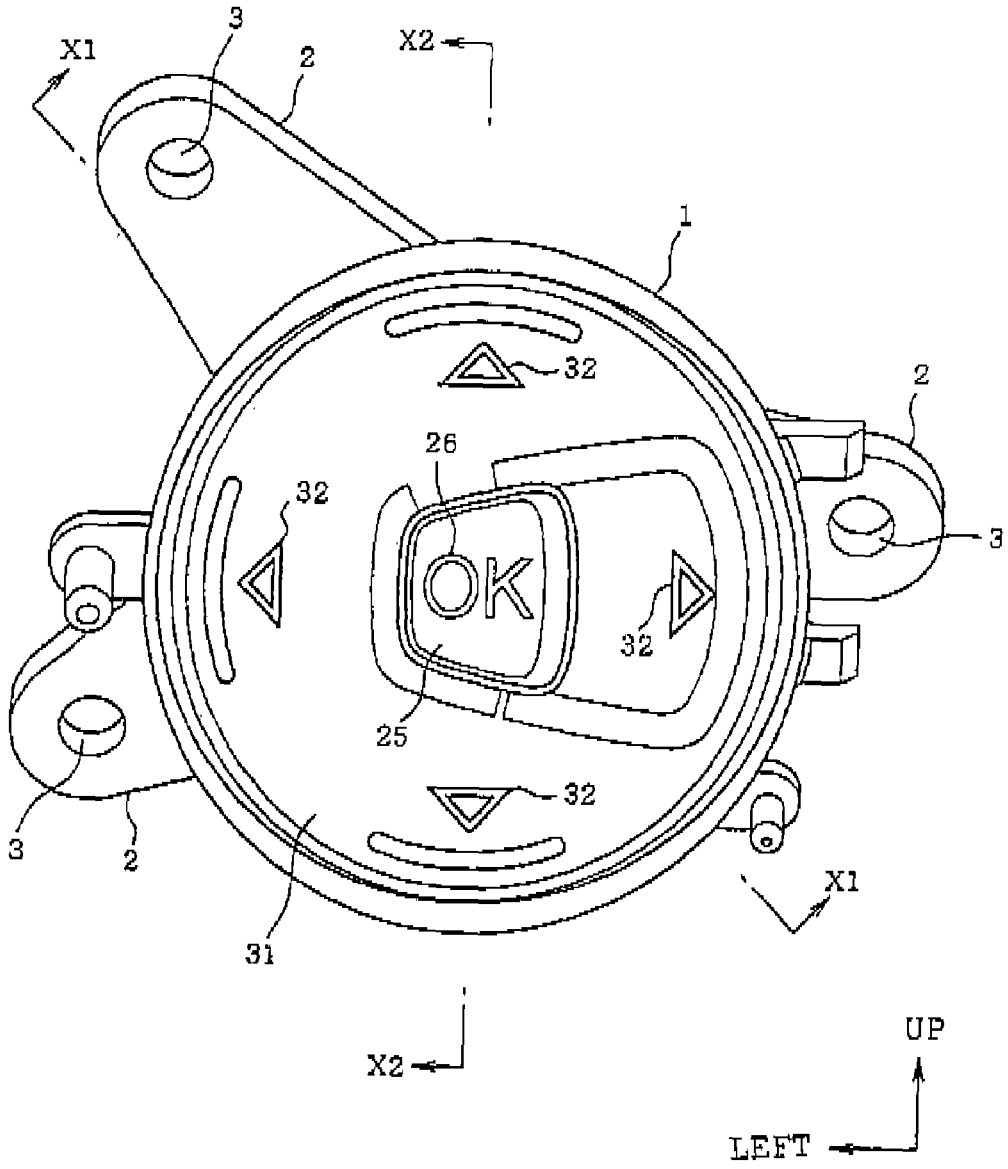
FIG. 3 is a diagram when viewed in the direction of arrow X3 in FIG. 1.
Figure 4:
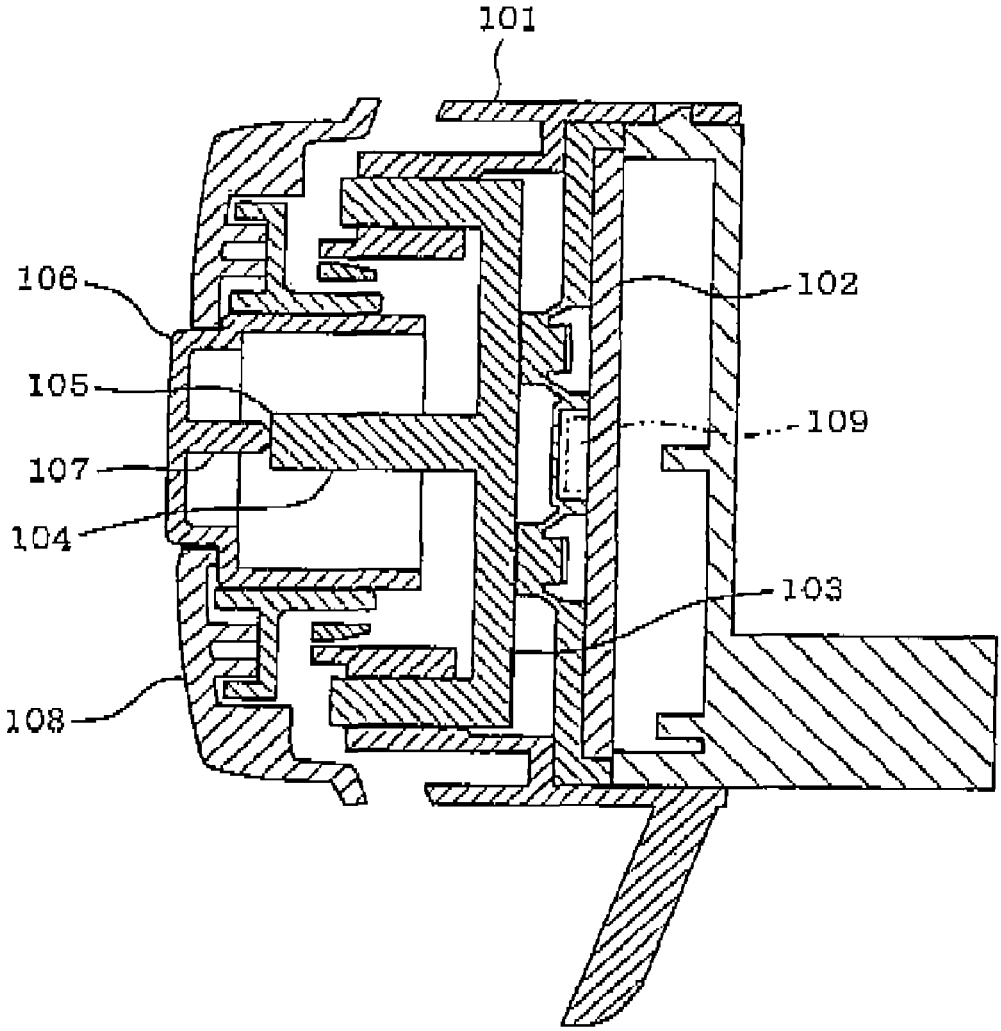
FIG. 4 is similar to FIG. 1 showing a related-art configuration.

As shown in FIG. 1, a push knob 24 is attached to the switch case 1. The push knob 24 is to be pushed backward by a finger of a car driver and corresponds to an internal knob. The push knob 24 assumes an angularly-cylindrical shape oriented in the front-back direction. As shown in FIG. 3, an operation plate 25 that closes the front surface of the push knob 24 is provided on the push knob 24. The push knob 24 is made of a colored, opaque, and optically-nontransparent synthetic resin. A mark 26 that is made of transparent synthetic resin and that assumes the shape of letter OK is fixed to the operation plate 25 of the push knob 4. The mark 26 opposes the internal LED 7 by way of the through hole 18 of the internal pusher member 16 and is illuminated from the behind as a result of emission of light from the internal LED 7.

As shown in FIG. 1, two legs 27 are made on the push knob 24. The respective legs 27 protrude from rear end face of the push knob 24. Working faces 28 are made at rear end faces of the respective legs 27. Each of the working faces 28 is made of a spherical surface whose curvature is different from that of the guide surface 17 of the internal pusher member 16. As the working faces 28 of both legs 27 move while remaining in point contact with the guide surface 17 of the internal pusher member 16, the push knob 24 can be tilted in any of four directions in FIG. 3; namely, up, down, right, and left directions, around the center point P on the guide surface 17 of the internal pusher member 16.

As shown in FIG. 1, an angular knob holder 29 is fixed to the outer periphery of the push knob 24. The knob holder 29 is made of a colored, opaque, optically-nontransparent synthetic resin, and a knob receiver 30 is made on the knob holder 29. The knob receiver 30 assumes an annular shape projecting from the outer periphery of the knob holder 29, and a four-way knob 31 is fixed to the knob receiver 30. The four-way knob 31 is made of a colored, opaque, optically-nontransparent synthetic resin and corresponds to an external knob. As shown in FIG. 3, the four-way knob 31 assumes an annular shape encircling the push knob 24. Four marks 32 made of transparent synthetic resin are fixed to the four-way knob 31. Each of the four marks 32 shows an operation position used when the car driver pushes the four-way knob 31 in a backward direction, and the four marks are forwardly positioned opposite the external pusher member 23. The four-way knob 31 corresponds to an external knob.

As shown in FIGS. 2A and 2B, the knob receiver 30 of the knob holder 29 has four openings 33. Each of the four openings 33 is formed from a through hole, and the four openings are positioned at the rear of the marks 32 of the four-way knob 31. Light projected form the external LED 8 and the external LED 9 pass through the respective four openings 33. The four marks 32 of the four-way knob 31 are illuminated by the light passed through the four openings 33. Four pusher operation portions 34 are made on the knob receiver 30 of the knob holder 29. The four pusher operation portions 34 protrude backwardly from the knob receiver 30 and oppose, from the front, the external pusher member 23 with clearance therebetween while the push knob 24 and the four-way knob 31 are in a non-operation state.

In a state where the car driver does not operate the push knob 24 or the four-way knob 31, both the push knob 24 and the four-way knob 31 remain stationary at their neutral positions. The neutral positions refer to positions where neither the push knob 24 nor the four-way knob 31 are tilted in any of the four directions; namely, up, down, right, and left directions, and linearly move in the backward direction. When the car driver backwardly pushes any of the four marks 32 of the four-way knob 31 while the push knob 24 and the four-way knob 31 are in their neutral positions, the working faces 28 of the respective legs 27 of the push knob 24 move while remaining in contact with the guide surface 17 of the internal pusher member 16, whereupon the push knob 24 is inclined around the center point P on the guide face 17 in the direction in which the four-way knob 31 is actuated, in conjunction with the four-way knob 31.

When the car driver backwardly pushes the push knob 24 while the push knob 24 and the four-way knob 31 remain tilted, the working faces 28 of both legs 27 of the push knob 24 do not move along the guide surface 17 of the internal pusher member 16, and the push knob 24 linearly moves backwardly along with the four-way knob 31. Of the four pusher operation portions 34 of the knob holder 29, the pusher operation portion corresponding to the tilted direction of the four-way knob 31 presses the rear external pusher member 23 from the non-operation position to the operation position by means of operation force of the push knob 24, whereby the external pusher member 23 moves the rear external contact holder 21 from the OFF position to the ON position in defiance to the elastic force of the expandable portions 20. The external movable contact point of the rear external contact holder 21 is brought into contact with the rear external stationary contact point. Concurrently, the push knob 24 pushes the internal pusher member 16 from the non-operation position to the operation position, and the internal pusher member 16 elastically deforms the expandable portions 12 of both internal contact holders 13 by means of operating force of the push knob 24, thereby bringing the respective internal movable contact points 14 into contact with the rear internal stationary contact points.

When the car driver releases his/her finger from the push knob 24 after having backwardly pushed the push knob 24, the external contact holder 21 resets itself from the ON position to the OFF position by elastic restoration force of the expandable portions 20, whereupon the external movable contact point is released from the rear external stationary contact point. Concurrently, the respective internal contact holders 13 reset themselves from the ON position to the OFF position by elastic restoration force of the expandable portions 12, whereupon the respective internal movable contact points 14 are released from the corresponding rear internal stationary contact points. When the external switch and the internal switch are switched from their electrical ON positions to their electrical OFF positions, the external pusher member 23 resets itself from the operation position to the non-operation position by way of the external contact holder 21, thereby forwardly pushing the four-way knob 31. The internal pusher member 16 resets itself from the operation position to the non-operation position by elastic restoration force of the respective internal contact holders 13, thereby forwardly pushing the push knob 24. Therefore, the four-way knob 31 resets itself to the neutral position in conjunction with the push knob 24.

The first embodiment yields the following advantage.

When the car driver has backwardly pushed the four-way knob 31, both legs 27 of the push knob 24 are allowed to slide along the guide surface 17 of the internal pusher member 16. In accordance with the sliding action, the four-way knob 31 is tilted in the direction of operation of the four-way knob 31 along with the push knob 24. When the car driver has backwardly pushed the push knob 24 while the push knob 24 and the four-way knob 31 remain in their tilted states, both legs 27 of the push knob 24 are prohibited from sliding along the guide surface 17 of the internal pusher member 16. Accordingly, the push knob 24 linearly, backwardly moves along with the four-way knob 31, whereby the internal switch and the external switch are operated. Therefore, the through hole 18 is made in the internal pusher member 16, and light is projected from the internal LED 7 of the switch board 6 to the push knob 24 by way of the through hole 18 of the internal pusher member 16, whereby the mark 26 of the push knob 24 can be illuminated.

What is claimed is:

1. A switch comprising:

a switch case that supports a switch board;

a pusher member that is provided in the switch case, is operative to be pushed from a first position to a second position located closer to the switch board than the first position, and includes a spherical guide surface on a side opposite to the switch board and a through hole;

an internal knob that is operated by a user and includes a plurality of legs supported by the guide surface;

a light source that is provided on the switch board and illuminates the internal knob by projecting light into the internal knob through the through hole; and an annular external knob that is operated by the user and surrounds the internal knob, wherein, when the external knob is pushed toward the switch board, the guide surface allows sliding action of the plurality of legs to tilt both the external knob and the internal knob, wherein, when the internal knob is pushed toward the switch board while the internal knob and the external knob remain tilted, the plurality of legs are prohibited from performing sliding action, thereby causing the internal knob to linearly move toward the switch board along with the external knob, wherein the pusher member is pushed by the internal knob from the first position to the second position in response to the internal knob linearly moving toward the switch board along with the external knob, and wherein the switch board includes an external switch that is operated in response to the external knob linearly moving toward the switch board and an internal switch that is operated by way of the pusher member in response to the internal knob linearly moving toward the switch board.

2. The switch according to claim 1, wherein a plurality of the external switches are arranged along a common circular path, and the internal switch is arranged at a radially inside of the common circular path.

3. The switch according to claim 1 further comprising an external knob inserted into a pusher housing portion formed at the switch case, wherein when the external knob linearly moves toward a switch board, the external knob pushes the external switch through the external pusher member.

* * * * *